US011808443B2

(12) United States Patent
Baaijens et al.

(10) Patent No.: US 11,808,443 B2
(45) Date of Patent: Nov. 7, 2023

(54) LIGHTING DEVICE, LIGHTING SYSTEM AND USE THEREOF

(71) Applicant: SIGNIFY HOLDING B.V., Eindhoven (NL)

(72) Inventors: Johannes Petrus Wilhelmus Baaijens, Eindhoven (NL); Wiebe Wagemans, Eindhoven (NL); Bianca Maria Irma Van Der Zande, Eindhoven (NL); Kars-Michiel Hubert Lenssen, Eindhoven (NL); Martinus Petrus Joseph Peeters, Eindhoven (NL); Remy Cyrille Broersma, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/534,242

(22) PCT Filed: Nov. 26, 2015

(86) PCT No.: PCT/EP2015/077785
§ 371 (c)(1),
(2) Date: Jun. 8, 2017

(87) PCT Pub. No.: WO2016/096367
PCT Pub. Date: Jun. 23, 2016

(65) Prior Publication Data

US 2018/0073712 A1 Mar. 15, 2018

(30) Foreign Application Priority Data

Dec. 16, 2014 (EP) ..... 14198292

(51) Int. Cl.
*F21V 23/04* (2006.01)
*F21V 9/40* (2018.01)
(Continued)

(52) U.S. Cl.
CPC ..... *F21V 23/04* (2013.01); *F21S 6/003* (2013.01); *F21V 9/20* (2018.02); *F21V 9/40* (2018.02);
(Continued)

(58) Field of Classification Search
CPC ..... F21V 23/04; F21V 9/40; F21V 33/0008; F21S 6/003; H05B 33/0869; H05B 33/0872; H05B 45/20; H05B 45/22
See application file for complete search history.

(56) References Cited

U.S. PATENT DOCUMENTS 8,100,552 B2 * 1/2012 Spero ..... H05B 45/395 362/276
2003/0218180 A1 * 11/2003 Fujiwara ..... H01L 33/505 257/100
(Continued)

FOREIGN PATENT DOCUMENTS

DE 102007007778 A1 6/2008
EP 1462711 A1 9/2004
(Continued)

*Primary Examiner* — Evan P Dzierzynski
*Assistant Examiner* — Nathaniel J Lee

(57) ABSTRACT

A lighting device comprising a light source being configured to generate source light of a white light emission spectrum having a color correlated temperature (CCT) in a range of 2500-20000K and comprising a control unit being configured to control a lighting element for tuning of the source light with respect to a ratio between a first emission peak in a wavelength range of 460-490 nm and a second emission peak in a wavelength range of 430-460 nm. Thus a lighting device with a tunable/adjustable spectrum is provided that can switch between a first operation state of energy efficiency lighting with a blue peak in the second wavelength range of 430-460 nm, but with blue hazard risk, and a second
(Continued)

operation state of less efficient but safe, healthy lighting with a biological stimulant having a blue peak in the first wavelength range of 460-490 nm.

13 Claims, 3 Drawing Sheets

(51) Int. Cl.

| | |
|---|---|
| ***F21S 6/00*** | (2006.01) |
| ***F21V 33/00*** | (2006.01) |
| ***H05B 45/20*** | (2020.01) |
| ***H05B 45/22*** | (2020.01) |
| ***F21V 9/20*** | (2018.01) |
| *H05B 33/08* | (2020.01) |
| *F21Y 115/10* | (2016.01) |
| *F21Y 113/13* | (2016.01) |

(52) U.S. Cl.
CPC ..... *F21V 33/0008* (2013.01); *H05B 45/20* (2020.01); *H05B 45/22* (2020.01); *F21Y 2113/13* (2016.08); *F21Y 2115/10* (2016.08)

(56) References Cited

U.S. PATENT DOCUMENTS

2006/0164005 A1* 7/2006 Sun ..... C09K 11/7774 313/503
2008/0158871 A1* 7/2008 McAvoy ..... H05B 45/22 362/227
2008/0186448 A1* 8/2008 Ishak ..... G02C 7/104 351/159.6
2009/0059603 A1* 3/2009 Recker ..... H05B 47/19 362/362
2010/0063566 A1* 3/2010 Uchiumi ..... A61M 21/00 607/88
2010/0118510 A1* 5/2010 Bailey ..... F21K 9/64 362/231
2010/0289433 A1* 11/2010 Lau ..... F21V 21/0885 362/106
2011/0299277 A1 12/2011 Ehara
2012/0014095 A2* 1/2012 Waters ..... A42B 1/244 362/382
2012/0176767 A1 7/2012 Whitfield et al.
2014/0049191 A1 2/2014 Maxik et al.
2014/0185281 A1 7/2014 Lee et al.
2014/0306620 A1* 10/2014 Maxik ..... A61M 21/00 315/294
2014/0327361 A1* 11/2014 Zoorob ..... H05B 45/00 257/89
2015/0316688 A1* 11/2015 Cefalo ..... G02B 1/14 252/586

FOREIGN PATENT DOCUMENTS

JP 2012064860 A 3/2012
WO 2007114614 A1 10/2007
WO 2008069101 A1 6/2008
WO 2008072196 A1 6/2008
WO 2010122312 A1 10/2010
WO 2012144087 A1 10/2012
WO 2014165692 A1 10/2014

* cited by examiner

LIGHTING DEVICE, LIGHTING SYSTEM AND USE THEREOF

CROSS-REFERENCE TO PRIOR APPLICATIONS

This application is the U.S. National Phase application under 35 U.S.C. § 371 of International Application No. PCT/EP2015/077785, filed on Nov. 26, 2015 which claims the benefit of European Patent Application No. 14198292.6, filed on Dec. 16, 2014. These applications are hereby incorporated by reference herein.

FIELD OF THE INVENTION

The invention relates to a lighting device for issuing light with adjustable spectrum. The invention further relates to a kit of parts, a lighting system comprising such a lighting device, and to usage of both the lighting device and lighting system.

BACKGROUND OF THE INVENTION

Light is a fundamental part of life and affects us in a variety of ways—visually, psychologically and biologically. The most obvious effect of light on humans is to enable vision: 83% of information we receive from the world, comes through our eyes. In recent decades a lot is learned about the biological or non-image-forming effects of light, for example a new photoreceptor residing within a cell type in the retina of the eye was identified. It is called melanopsin and regulates the biological effects of light. When ocular light (light perceived by the eyes) reaches these cells, a complex chemical reaction occurs, producing electrical impulses that are sent via separate nerve pathways to our biological clock, the suprachiasmatic nuclei (SCN). The SCN in turn regulates the circadian (daily) and circannual (seasonal) rhythms of a large variety of bodily processes, such as sleep, and some important hormones, such as melatonin and cortisol, essential for a healthy rest-activity pattern. One speaks of the circadian system, generating the circadian rhythm of biological processes. The photoreceptor is most sensitive to blue light, in particular for light between 440 and 490 nm with peak sensitivity in a wavelength range of 470-480 nm. The biological clock controls our biorhythms and under natural conditions light synchronizes our internal body clock to the earth's 24-hour light-dark rotational cycle. Without the regular 24-hour light-dark cycle, our internal clock would be autonomously running with its own period, which varies from person to person. The average period in man is about 24.2 hours, a bit slower than the natural light-dark cycle. Without resetting by light, even this small discrepancy would produce recurrent periods during which the body physiology (through for instance melatonin, cortisol and core body temperature) would tell the body it was time to sleep during the daytime and be awake at night. This situation can be compared with jet lag during transmeridional travel, and is associated with negative effects such as fatigue, headache, and reduced alertness and well-being.

Currently, people are spending more and more time indoors, i.e. about 80% of their time. As a consequence they experience too less daylight to reset their biological clock. Research shows these effects especially in hospitalized people and elderly in nursing homes. However, more and more offices are mentioned as well for countries in the Northern hemisphere as especially in wintertime office employees hardly see any daylight. To compensate for daylight, lighting solutions with an enhanced biological component or just higher intensity levels could reset the bodily rhythm as demonstrated in laboratory and field studies. Hence, human beings mainly living indoors need pleasant, white, working light offering exposure to sufficient blue light as well, to regulate there biorhythm and hormonal secretion processes.

However, both indoor and outdoor a general problem for exposure by humans to higher doses of blue light is a risk of retinal damage in human eyes. This effect is called "blue hazard risk". For example, at a sunny summer day, people will be exposed to this blue light hazard and multiple studies such as the Beaver Dam study demonstrate that exposure to a lot of sun shine is one of the causes to develop the retinal diseases macula degeneration ending in blindness. People at risk are elderly that demonstrate signs of retinal damage and very young children (up till 10 years old) as they have not yet developed the internal protection mechanism, being a lens that filters the blue light. Outdoors, the general measure to limit the blue hazard risk is that humans wear sun-glasses. Indoors, a known measure from the prior art to limit the blue hazard risk is the use of a lighting device which can be dimmed.

A working light for issuing light with adjustable spectrum is known from US20120176767A1. The known light source comprises a plurality of light emitting devices (LEDs). The combined output of the various LEDs renders the light source to have a white emission spectrum with an intensity, and hue or chromaticity that offers viewing comfort to persons. The emission spectrum issued by the known working light is dimmable in brightness and adjustable in color to enhance the visual acuity and to improve the comfort of lighting to the eyes of a human.

Yet the known lighting device has the disadvantage that reduction of blue hazard risk is relatively poor because the known working light it is aimed at comfort to the eyes and improvement of visual acuity, but not aimed at reduction of blue hazard risk.

SUMMARY OF THE INVENTION

It is an object of the invention to provide a lighting device comprising a light source of the type as described in the opening paragraph in which at least one of the abovementioned disadvantages is counteracted. Thereto the lighting device of the type as described in the opening paragraph comprises a light source being configured to generate source light of a white light emission spectrum having a color correlated temperature (CCT) in a range of 2500-20000K and comprises a control unit being configured to control a lighting element for tuning of the source light with respect to a ratio between a first emission peak in a wavelength range of 460-490 nm and a second emission peak in a wavelength range of 430-460 nm, the lighting element being at least one of a tunable light filter, switchable lighting element, dimmable lighting element, a shift in the CCT of the white emission spectrum because of the tuning of the ratio between the first and second emission peak is reversed by adjustment of the emission spectrum in a wavelength range longer than 490 nm.

A typical lighting element to be controlled is at least one of a dimmable blue lighting element, a switchable blue lighting element, and a tunable blue light filter. Preferably, the lighting element is a dimmable lighting element of the light source and/or a switchable lighting element of the light source. The lighting element then preferably comprises a first lighting element issuing light having a first maximum emission peak in a wavelength range of 460-490 nm during operation, and a second lighting element issuing light having a second maximum emission peak in a wavelength range of 430-460 nm during operation. The control unit to control the light emitting elements can, for example, be a switch, a power knob, a pulse width modulation (PWM)-unit, amplitude modulation (AM) unit, current control unit. Ways to control the filter can be via a variable voltage source, transverse shift of a filter having variable thickness or dope concentration transverse to the propagation direction of light as issued by the light source that passes through said filter.

The lighting device is further characterized in that the CCT of the white emission spectrum is not affected by, or in other words, is not causal related to the tuning of the ratio between the first and second emission peak. To attain this effect, the sensor of the lighting device measures the spectral composition of the initial spectrum and calculates from that the CCT. Subsequently the spectrum of the follow-up light spectrum is adapted in emission intensity in the longer wavelength ranges, i.e. the green to red-part of the spectrum, to compensate for and/or reverse the effect on and/or the shift of the CCT caused by the difference in the second emission peak between the initial and follow-up spectrum. It is appreciated by users if one wants or needs to switch from energy efficient lighting to safer, healthier lighting to limit the blue hazard risk, and said switching involves a different ratio between the first and second emission peak, without the CCT of the emission spectrum to change. In particular this is appreciated if two people are in the same room that, when said switch made on behalf of the first person, said switch is not noticed by the second person because the CCT remains constant.

Current white LED lamps, such as the known working light, usually use a blue pump LED with a peak wavelength of 450 nm that is converted by a phosphor into white light. This choice has been made to have highest efficiency of the white light, which is a key product property for many customers. Such a known lighting device has two important drawbacks, because the blue LED peak at wavelength of 450 nm has:

- significant overlap with the wavelength interval 415 nm-455 nm, in which the human eye is sensitive for damage, i.e. said blue hazard risk;
- not maximized energy content in the wavelength range 450-500 nm, which wavelength range is responsible for biological stimulation of humans, of which the sensitivity peaks at about 475 nm.

This invention describes the use of a lighting device with a tunable/adjustable spectrum that can be used in extremes of a first operation state of energy efficiency lighting with a blue peak in the second wavelength range of 430-460 nm, but with blue hazard risk, or of a second operation state of less efficient but safe, healthy lighting with a biological stimulant having a blue peak in the first wavelength range of 460-490 nm. From experiments it appeared that a lighting device having, for example, a blue LED with peak wavelength in the first wavelength range of 460-490 nm, reduces the blue hazard risk with 30% and it increases the biological stimulus with 20%. However, it creates a loss of energy efficiency of 20% compared to the lighting device with a blue LED having an emission peak in the second wavelength range of 430-460 nm.

To attain a yet more prominent distinction between the two extreme operation states, an embodiment of the lighting device is characterized in that the first emission peak is in a wavelength range of 465-475 nm, and the second emission peak is in a wavelength range of 445-455 nm, for example, an emission peak at about 475 nm in the second operation state, and a emission peak at about 450 nm in the first operation state. Calculations with the Essilor-fit sensitivity curve for various CCT values, performed on the relative hazard risk of eye damage due to blue radiation by comparing the damage for a 475 nm blue led pump and a 450 nm blue led pump, revealed that 29% reduction at 2700K to 34% reduction at 6500 K of radiation damage is obtained.

To enable the selection between the first operation state and the second operation state, the lighting device can, for example, be controlled by:

- A user interface (=UI), for example a smart phone, a laptop, a tablet or a remote or wall mounted control, on which the user can select between "energy efficient light" and "healthy light";
- A lighting system that selects between "energy efficient light" and "healthy light", based on sensor and/or clock input:
  - Sensor can be presence detection, speed of human crowd movement detection, and residence time detection of humans.
  - Clock can distinguish between day and night hours.

The selection can be made between two, for example fixed, operation states "energy efficient light" and "healthy light". Such a lighting system, generally with white light, then has two fixed settings:

- Setting 1: Relative high contribution of blue light between 460 and 490 nm, compared to blue light between 430 and 460 nm;
- Setting 2: Relative low contribution of blue light between 460 and 490 nm, compared to blue light between 430 and 460 nm.

The system can switch between the setting 1 and 2 for different situations, for example:

Change between 1 and 2 as a function of the time of the day to help keeping the circadian rhythm;

Switch from 1 to 2 when dimming the light intensity or decreasing the CCT as warmer colors and lower light levels are generally used when less energizing is needed;

Switch from 2 to 1 when increasing a UI control input that is labelled energizing;

Switch from 2 to 1 when activating a UI control input that is labelled to improve eye-comfort by e.g. the percept of sharper vision.

Switch from 2 to 1 if higher energy savings are needed.

Examples of situations in which a lighting system with two fixed operation states or continuous configurable between said two operation states, is meaningful, are:

- When persons are hospitalized e.g. hospitals or nursing homes, the system can switch from optimal energy efficient light to light for biological stimulant in the morning and late afternoon to reset their biological clock for a good wake-sleep rhythm, a deep sleep and a higher daily activity pattern without compromising on the visual comfort of the residents. In this way the recovery process of hospitalized people will be supported while nursing home resident will be either vitalized, or in case of Alzheimer patients also benefits of reduction of the cognitive decline, less aggression and better sleep can be claimed. Therefore and embodiment of the lighting device is characterized in that the light source is tunable in light intensity and that upon dimming and/or lowering the CCT, the ratio between the first and second emission peak decreases.
- When persons are staying longer in the same lighting, e.g. during office work, and hotels day meetings, the system can switch after a certain residence time of the user from "energy efficient light" to "healthy light". For example, if the residence time exceeds 2 hours, the system will automatically switch to the "healthy light" during the next 2-3 hours. In this way a balance is made between energy efficient light and healthy light for biological stimulant. In hospitality meeting rooms, where people stay usually the entire day, this can be used optimally and intuitively with the benefits of prolonged attention and vitality.

In indoor areas where during daytime many more people are present, and in the case a space needs to be lit during absence or with only little people, like in a shop or in an office after 6 o clock in the evening, the spectrum can be switched from "healthy light" mode to "energy efficient" mode. Also, during evening or night time when certain areas that are not occupied by humans, the "energy efficient light" setting can be used, to let the space being lit for security reasons (anti-burglar light).

In public transport, when people are moving fast through corridors and waiting areas, the "energy efficient light" can be used. However, when it is very crowded and people have to wait longer on the same position, the "healthy light" can be used.

In airplanes, the light quality can be set depending on the flight time of the airplane: on shorter flights the "energy efficient light" can be used while on longer flights "healthy light" can be used.

Users can carry a personal device that communicates their presence in the space to the lighting system, e.g. via RF communication, so that the lighting system knows easily their residence times. Also video images can be used to identify users and measure their residence times.

The expression lighting device comprises devices as flood light, accent light and working light. In this respect "working light" is to be understood as a lighting device which has for its main purpose to illuminate an area or space for people to work, recover, rest and/or read, for example, a luminaire for illumination of a room or space in an office, hospital, nursing home, psychiatric center, restaurant, library, study center, at home or of an outside space like parking lot, terrace, or billboard.

The expression "white light" refers to the chromaticity of a particular light source or the "color point" of the light source. For a white light source, the chromaticity may be referred to as the "white point" of the source. The white point of a white light source may fall along a locus of chromaticity points corresponding to the color of light emitted by a black-body radiator heated to a given temperature. Accordingly, a white point may be identified by a correlated color temperature (CCT) of the light source, which is the temperature at which the heated black-body radiator matches the color or hue of the white light source. White light typically has a CCT of between about 2500 and 20000K. The term white light for general lighting especially is generally in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL. White light with a CCT of about 4000K has a neutral white color. White light with a CCT of about 8000K or higher is more bluish in color, and may be referred to as "cool white" or "crisp white". "Warm white" may be used to describe white light with a CCT of between about 2500K and 3000K, which is more reddish in color.

The expression "emission peak" means a local maximum in the emission wavelength which is at least twice the intensity in the number of photons of the emission of near/adjacent emission wavelengths.

An embodiment of the lighting device is characterized in that the light source is tunable in light intensity (dimmable). In applications where a biological stimulant is required, for example hospitals or nursing homes, a dynamic curve including a high intensity/high colour temperature is used. This can lead to visual discomfort and even to migraine, visual strain, and dissatisfaction. By reducing the luminance contrast as a result of lower intensity but maintaining the biological response visual comfort, biological stimulation and energy saving can be simultaneously taken into account. The expression "dimmable" in this respect means that the intensity or brightness of the light is controllable in a continuous manner or in at least three steps, i.e. it can be gradually boosted or dimmed and eventually turned off/on. In particular LEDs are suitable for tuning at least one of the intensity or spectral distribution of the emission spectrum as these are easily dimmable and in view of the usually large number of LEDs for generating the spectrum, the fraction of active operating LEDs is easily changeable. Thereto an embodiment of the lighting device is characterized in that the first lighting element comprises a first LED and in that the second lighting element comprises a second LED. In most cases the working light also comprises a, preferably tunable/dimmable, green light emitting LED and a, preferably tunable/dimmable, orange-red or red light emitting LED as a third respectively as a fourth lighting element, for example for obtaining white light with a CCT of 7000K or lower.

An embodiment of the lighting device is further characterized in that the melatonin suppression of the white emission spectrum is not affected by, or in other words, is not causal related to the tuning of the ratio between the first and second emission peak. To attain this effect, for the mutually tuned emission spectra the following requirement is essentially fulfilled:

$$I_1 * R_1 + I_2 * R_2 \approx \text{constant},$$

wherein $I_1$ is the intensity of the emission spectrum at the first emission peak;

$R_1$ is the melatonin responsiveness at the first emission peak;

$I_2$ is the intensity of the emission spectrum at the second emission peak;

$R_2$ is the melatonin responsiveness at the second emission peak.

The blue hazard function extends roughly from 400 nm to 500 nm with a maximum sensitivity at about 435 nm. The circadian rhythm response function, which corresponds essentially to the melatonin suppression curve, differs from the blue hazard function response curve in that it is broader, i.e. it extends well beyond the 400 nm and 500 nm and in that it has a relatively broad maximum at about 465 nm. The differences between the blue hazard function and the melatonin suppression function two curves enables to tune the spectrum from safe and healthier light to more efficient light while keeping the melatonin suppression essentially unaffected. The energy efficient 450 nm blue pump spectrum has a practically 100% overlap with the blue hazard function, while the overlap of the less energy efficient 470 nm blue pump spectrum with the blue hazard function is significant less. Hence, the 470 nm blue pump spectrum is safer and healthier than the 450 nm blue pump spectrum but less energy efficient. Both the 450 nm blue pump and the 470 nm blue pump spectra show a significant and about the same overlap with the circadian rhythm response function, and both spectra can be effectively be used for control of the circadian rhythm, yet the 470 nm blue pump spectrum being slightly different in this respect than the 450 nm blue pump spectrum.

As discussed above, the working light can be characterized in that the ratio can be controlled by means of a tunable light filter, hence without necessarily switching on/off any of the lighting elements. The active range in the visible spectrum for said tunable light filter preferably is for wavelengths <=500 nm, but especially effectively tunable for a wavelength range of <=460 nm. As an absorption filter leads to some light loss, the use of the filter should be limited as much as possible to a specific wavelength range, i.e. in this particularly to the range of blue light related to the hazard risk, i.e. in the range of 430-460 nm. Alternatively the tunable filter is a light blocking, reflective filter, enabling re-use of the blocked and reflected light, hence the reflection filter is possibly more efficient than an absorption filter. A convenient way to control said tunable light filter is electrically. Suitable technologies for such electrically tunable filters include:

In-plane electrophoretics or electrokinetics: in these technologies electrically charged particles (suspended in a liquid) can be moved in and out of an area, thus changing the optically properties. If the particles contain material that blocks light of wavelengths from 500 nm or shorter, or even more effectively from 450 nm or shorter the desired filter effect is obtained. A yellow material with such properties could be "CI26 yellow" with absorption spectrum described by the company Contamac: http://www.contamac.com/files/Contamac%20Blue%20Light%20Article.pdf. See also http://www.contamac.com/Products/Intraocular-Lenses/CI26.aspx.

In general the electro-optically active particles could consist of the optical material and be chemically functionalized to get an electric charge or the particles can consist of a matrix (or shell) containing the optical material. In the latter case the optical material could also be a dye. Unless light diffusion would be desired, it is generally preferable to avoid backscattering; this can be achieved by using particles that are smaller than the wavelength of light using a matrix material that is index-matched with the liquid. It has been shown that electrophoretic and electrokinetic devices can be made in thin flexible foils or between glass substrates, which appeared to be suitable for a filter to be added to an LED.

Electrowetting: the function is to a certain extent analogous to electrophoretics, but with the big difference that liquid droplets are moved instead of particles. This means that the optical material should be a dye or solvable. It may be more difficult to make flexible filter foils.

In principle any technology for switchable windows could be considered, for example liquid crystal, electrochromics, electrofluidics, SPD, if the spectra can be adapted such that wavelengths below 460 nm are blocked or (specularly) reflected.

The invention further relates to a kit of parts comprising a lighting device according to the invention but wherein the tunable light filter is a personal wearable, preferably the wearable is selected from the group consisting of a cap, glasses, burka. Said personal wearable is mechanically disconnected from the light source, i.e. it is freely moveable with respect to light source at least within the emission area of the light source. Advantages of these wearable, personal tunable filters can be better personalization. Then, with one set of luminaires and with multiple users present, light can still be kept energy efficient even in the areas where people are present who need eye protection against blue hazard risk.

Embodiments of the lighting device issue light having a CCT in the range of 2500K to 6000K. At these relatively low CCTs the contribution of the blue radiation in the spectral output is relatively low, and hence for usually applied indoor lighting levels the risk on retinal damage for older people with an eye disease is acceptably low. Normal indoor lighting levels are generally in a range of 600 to 1000 lux.

The invention further relates to a lighting system comprising a lighting device according to the invention, a user carried device, and a sensor and/or clock configured to measure or sense sensor data during operation, said sensor data comprising a location of the user carried device, (ambient) spectral lighting conditions, and exposure time of the user carried device to the (ambient) lighting conditions, the sensor is further configured to provide the control unit with a sensor signal based on the sensor data which sensor signal is processed by the control unit to tune both the ratio between the first and second emission peak and their absolute emission intensity during operation.

The carrier device can be uploaded with general data which normally renders the lighting system to provide light with a good balance between efficient lighting and less efficient but safer and healthier lighting conditions which are adapted to the (ambient) spectral lighting conditions. Yet, an embodiment of the lighting system is characterized in that the user carried device is uploaded with personal user data, for example gender, age, race and personal eye-characteristics, like for example wearing glasses or contact-lenses. Both said personal data and sensor data are processed by the control unit to adjust both the emission spectrum and intensity to the personal user during operation. Lighting conditions are thus personalized and hence can be optimized for a specific person. One aspect of viewing comfort involves discernment of colors and fine details in work scenes. Human eyes tend to do this best with higher levels of illumination. However, higher illumination levels involve in general higher hazard risk due to more exposure to higher doses of harmful blue light. The sensor which monitors the exposure level and time of a person to the said blue light provides a sensor signal to the control unit. The control unit compares this sensor signal with the personal data of said person and subsequently adapts/corrects the spectrum of the lighting device with respect to the amount of blue light involving hazard risk in the spectral output or with respect to the illumination level, for example to an illumination level of at the most 2000 lux, for example 1000 lux, which is generally accepted to involve an acceptably low risk on retinal damage for older people with an eye disease. Thus the risk on eye damage to said person due to blue light involving hazard risk is counteracted. In nursing homes application of a 1000 lux in the eye during 2 hours to create biological effects is considered as being very effective. The correction for the amount of blue light in the spectrum can be attained via a one-time switchover between the two states "energy efficient light" and "healthy light" either via a one-time switch of the tunable filter or the lighting elements, or alternatively can likely even better be attained by switching with a certain, non-observable frequency of the tunable filter or lighting elements between said two states without compromising on vision.

The invention further relates to the use of the lighting device and to a lighting system according to the invention for providing efficient lighting and for providing relatively safe and healthy lighting and operation states intermediate between these efficient lighting and relatively safe and healthy lighting.

BRIEF DESCRIPTION OF THE DRAWINGS

The invention will now be further elucidated by means of the exemplary, non-limiting schematic drawings, in which.

DETAILED DESCRIPTION

Figure 1:
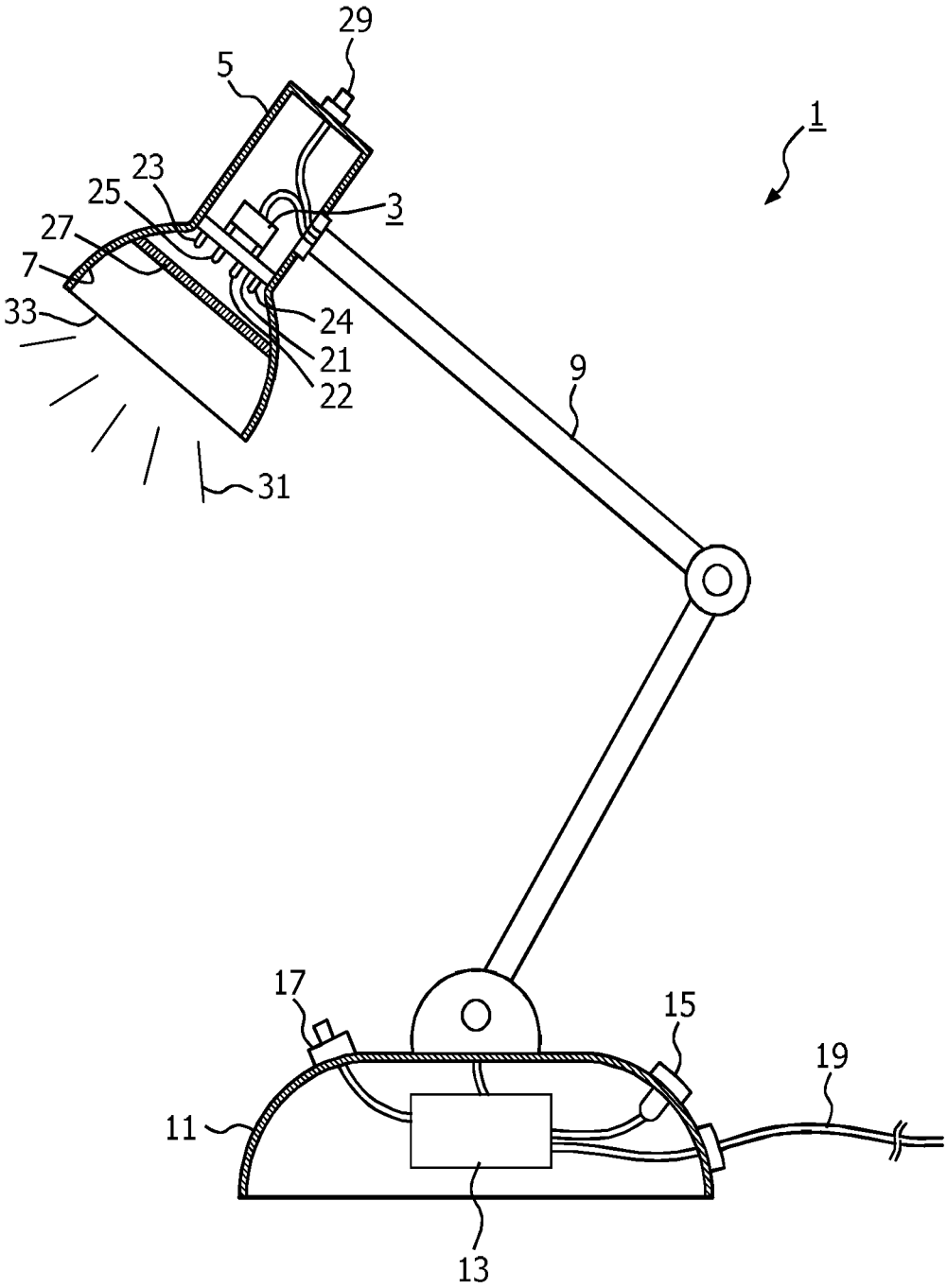
FIG. 1 shows a general view of a standing lighting device according to the invention.

FIG. 1 shows a lighting device 1, in the figure a desklight, comprising a light source 3 inside a housing 5 with reflector 7, but alternatively this reflector could be absent or be a diffuser, the housing being connected via a flexible joint pole 9 to a base 11. The base contains a control unit 13, an intensity adjustment knob 15 and a first control knob 17. The lighting device is connectable to mains via an electric cable 19. The light source comprises a plurality of LEDs 21 comprising at least a first 23 and a second lighting element 25. The embodiment shown in the figure further comprises as a third lighting element at least one green light emitting LED 22 and as a fourth lighting element at least one orange-red light emitting LED 24. Both the first and second lighting element can be a single LED or a plurality of LEDs. The lighting device by its light source issues a beam 31 of a, preferably white, spectrum which is tuned source light in intensity and/or in spectral composition (in particular of the ratio between the first and second emission peaks) via control knob 17. The intensity of light issued by the at least first lighting elements can be controlled by knob 17 independently from the second lighting elements and vice versa. The intensity of both the first and the second lighting elements can be adjusted by dimming or boosting or by turning on/off a fraction of the respective plurality of LEDs. The intensity of the beam 31 as issued from the lighting device is adjustable by knob 15, through a light exit window 33 of the reflector to the exterior. Additionally or alternatively, the reflector accommodates a tunable filter 27 for tuning of the spectral composition of the beam 31 issued by the lighting device, which is also shown in FIG. 1 and which is tunable by a second control knob 29. To accommodate for the fact that each eye is unique and reacts differently under different circumstances, a light that is tunable in spectrum and in intensity is thus provided. Hence, a lighting device, for example as shown in FIG. 1, is provided that is dimmable and enables different spectral emission resulting in tuning between efficient lighting and less efficient but safer, more healthier lighting.

Figure 2A:
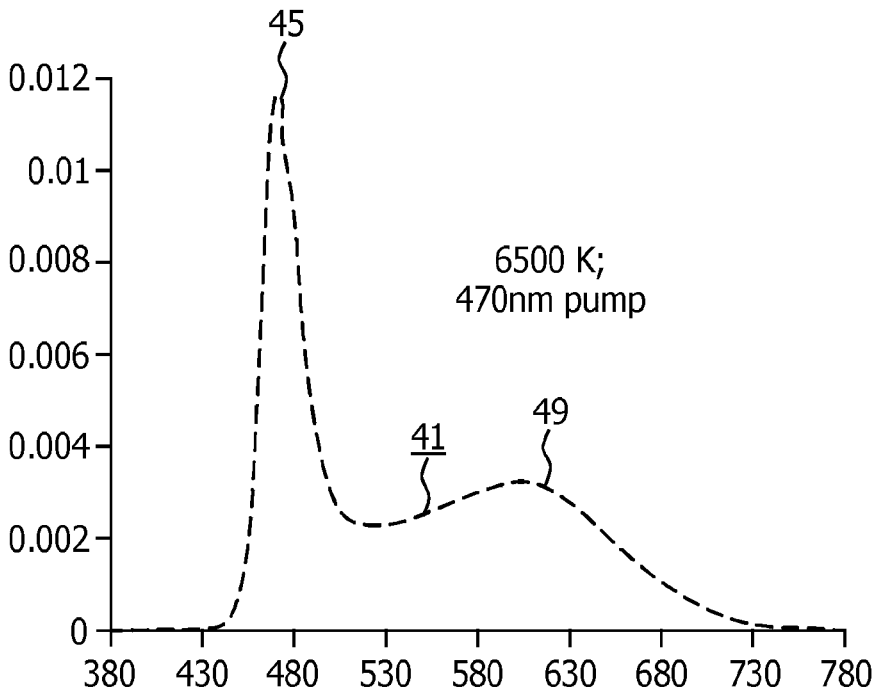
FIG. 2A-B show an example of a first respectively a second emission spectrum as issued by lighting devices according to the invention.
Figure 2B:
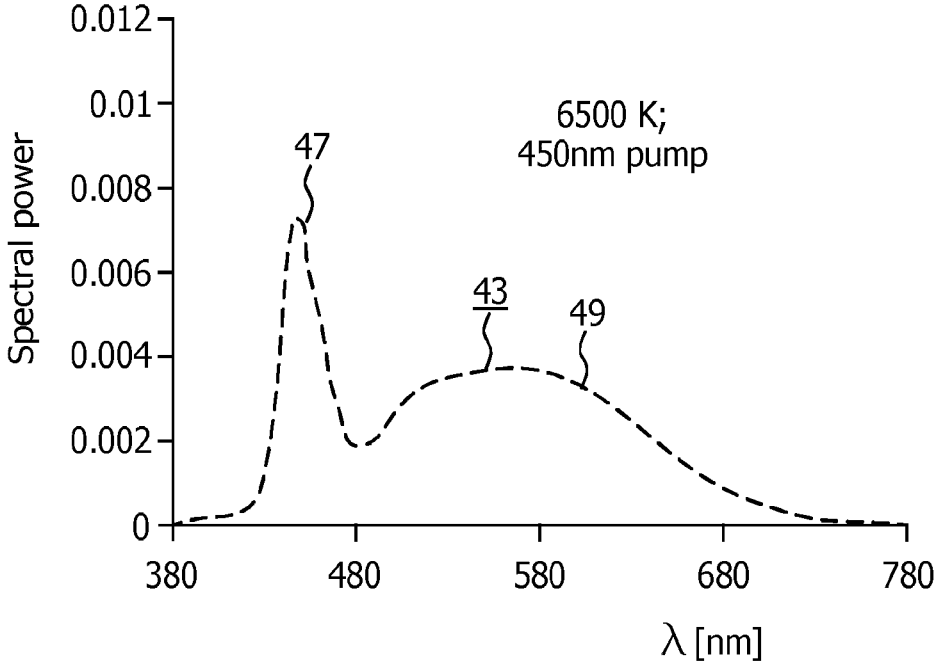

FIG. 2A-B shows an example of a first 41 respectively a second emission spectrum 43 as issued by the lighting device according to the invention. Both spectra are obtained by a respective LED comprising a combination of a LED blue pump and a phosphor. Blue light from the LED pump is partly transmitted through the phosphor and partly absorbed and converted into light of longer wavelengths, the combination of transmitted and converted light results in white light. The spectrum shown in FIG. 2A provides safer healthier and more stimulative light, and has one peak in the blue part of the spectrum with a first maximum 45 at about 470 nm due to use of a "470 nm LED blue pump". The spectrum of FIG. 2B provides more efficient lighting than the spectrum of FIG. 2A, yet with more blue hazard risk, and has one peak in the blue part of the spectrum with a second maximum 47 at about 450 nm, due to the use of a "450 nm LED blue pump". Both spectra have a correlated color temperature (CCT) of about 6500K, which corresponds to a daylight spectrum. To attain the same CCT, the shift from the first maximum to the second maximum is accounted for via slight modifications of the spectrum in the longer wavelength ranges, for example in that the peak 49 in the orange-red part of the spectrum is somewhat shifted towards the yellow wavelength range of the spectrum. Though the CCT of both spectra is the same, the spectra each have specific properties and effects which become apparent, for example, in the experienced prolonged attention and vitality of respondents.

Figure 3:
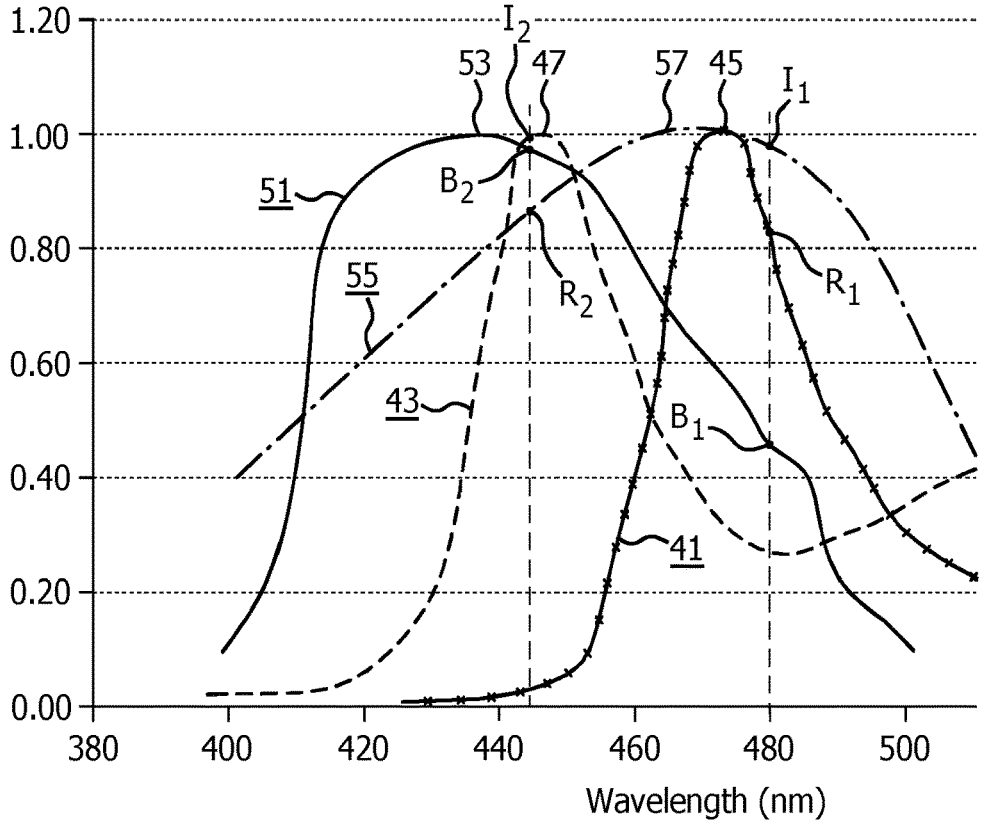
FIG. 3 shows the overlap for the blue part of emission spectra of the lighting devices of FIG. 2A respectively FIG. 2B with the blue hazard function and the circadian rhythm response function.

FIG. 3 shows the overlap for the blue part of emission spectra of the lighting devices of FIG. 2A respectively FIG. 2B with the blue hazard function and the circadian rhythm response function. All curves in FIG. 3 are shown on a scale normalized to 100% as function of the wavelength. As shown in FIG. 3 the blue hazard function 51 extends roughly from 400 nm to 500 nm with a maximum 53 at about 435 nm. The circadian rhythm response function 55 is even broader than the blue hazard function, and extends well beyond the 400 nm and 500 nm and having a relatively broad maximum 57 at about 465 nm. The energy efficient 450 nm blue pump spectrum has a practically 100% overlap with the blue hazard function, while the overlap of the less energy efficient 470 nm blue pump spectrum with the blue hazard function is significant less. Hence, the 470 nm blue pump spectrum is safer and healthier than the 450 nm blue pump spectrum but less energy efficient. Both the 450 nm blue pump and the 470 nm blue pump spectra show a significant overlap with the circadian rhythm response function, and both spectra can be effectively be used for control of the circadian rhythm, yet the 470 nm blue pump spectrum being slightly different in this respect than the 450 nm blue pump spectrum. To show the possibility to tune the spectrum from safe and healthier light to more efficient light while keeping the melatonin suppression essentially unaffected, FIG. 3 shows a case in which a first emission peaks at 480 nm and the second emission peaks at 445 nm, and respective intensities $I_{1,2}$, respective melatonin responsiveness $R_{1,2}$ and respective blue hazard responsiveness $B_{1,2}$. It is shown that the comparison between the emission spectra essentially fulfills the following requirement:

$$I_1 * R_1 + I_2 * R_2 \approx \text{constant},$$

wherein

- $I_1$ is the intensity of the emission spectrum at the first emission peak;
- $R_1$ is the melatonin responsiveness at the first emission peak;
- $I_2$ is the intensity of the emission spectrum at the second emission peak;
- $R_2$ is the melatonin responsiveness at the second emission peak.

Yet the responsiveness to the blue hazard function at the first and second emission maxima differs by more than a factor two.

Figure 4:
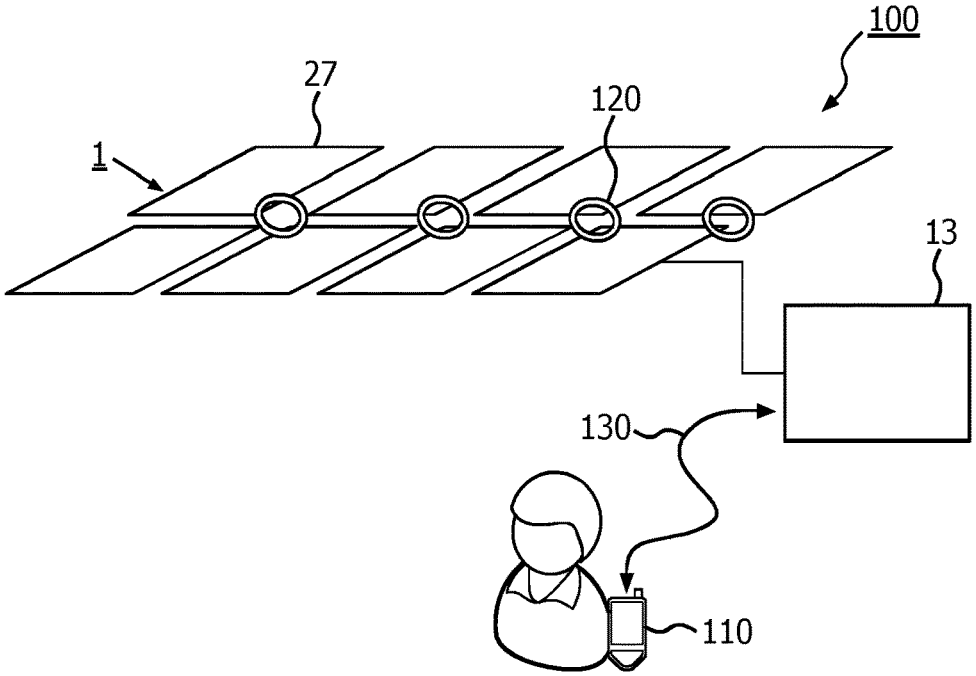
FIG. 4 shows a schematic drawing of an interactive lighting system with dose control of blue light involving blue hazard risk.

FIG. 4 shows a schematic drawing of an interactive lighting system 100 with dose control of light involving blue hazard risk. Thereto the lighting system comprises a lighting device 1 according to the invention, a user carried device 110, and a sensor 120 and/or clock configured to measure or sense sensor data during operation. The lighting device comprises an integrated tunable filter 27, a light source (not shown) and a control unit 13, which in the figure is located elsewhere in the lighting system outside the lighting device. The sensor is configured to communicate with the control unit via a sensor signal 130 based on the sensor data which sensor signal is processed by the control unit to tune both the ratio between the first and second emission peak and their absolute emission intensity during operation.

As location sensing can be used measurement of signal strength of e.g. Bluetooth signals or Wifi signals. The dose of blue hazard energy is the product of blue hazard energy multiplied with the time duration of the exposure. After initial calibrating of the lighting system it is known which dose is present in the room as function of the light settings. For a given maximum dose there is a maximal amount of exposure time.

In formula: $\text{Dosis}=C\int_{\lambda 1}^{\lambda 2}B(\lambda)I(\lambda)d\lambda*\Delta t$ with B(λ) the sensitivity curve for blue hazard radiation as function of wavelength and I(λ) the spectral power distribution of the emitted light; Δt is the exposure time of the emitted light.

The tunable filter can be integrated in the LED-module or can be part of the luminaire (for example included in the light diffusor). In an alternative embodiment the tunable filter is not integrated in the luminaire, but remote from it. This could be for example an (aftermarket) panel or foil that can be applied to the luminaire or placed in front of it or be hung above a table. It even could be "attached" to the individual consumer, for example in glasses (e.g. Google glass) or perhaps in caps. Advantages of remote filters can be better personalization, with one set of luminaires even with multiple users present and that light can still be kept bright outside the areas where people are present.

The invention claimed is:

1. Lighting device operable in a first and a second operation state for controlling exposure to blue light, said lighting device comprising:

a light source comprising blue LEDs and dimmable green and red LEDs, said light source being configured to generate source light of a white light emission spectrum having a color correlated temperature (CCT) in a range of 2500-20000K;

a control unit being configured to control a lighting element being at least one of a tunable light filter, switchable lighting element, dimmable lighting element for tuning of the source light with respect to a ratio between a blue light emission peak in a wavelength range of 460-490 nm and a second light emission peak in a wavelength range of 430-460 nm, said tuning further comprises an adaption in the emission intensity in the green to red part of the spectrum by controlling the dimmable green and red LEDs to compensate a shift in the CCT of the white emission spectrum caused by a tuning of the ratio between the first and second blue light emission peak upon a switch from the first to the second operation state, such that the CCT of the white emission spectrum is without change, wherein the control unit receives a measured spectral composition of an initial spectrum and calculates the CCT and wherein a follow-up light spectrum is adapted in emission intensity using only the dimmable green and red LEDs, to compensate for and/or reverse an effect on and/or the shift of the CCT caused by a difference in the second emission peak between the initial and follow-up spectrum.

2. Lighting device as claimed in claim 1, characterized in that the lighting element is at least one of a dimmable blue light emitting lighting element, a switchable blue light emitting lighting element, a tunable blue light filter.

3. The lighting device as claimed in claim 2, characterized in that the tunable light filter is tunable for a wavelength range of <460 nm, preferably for a wavelength range of 430-460 nm.

4. A kit of parts comprising the lighting device as claimed in claim 3, characterized in that the light source and the tunable light filter are mutually mechanically disconnected, and in that the lighting device is a personal wearable, wherein the personal wearable is selected from the group consisting of a cap, glasses, burka.

5. Lighting device as claimed in claim 1, characterized in that lighting element is at least one of a dimmable lighting element of the light source, a switchable lighting element of the light source and comprises a first lighting element issuing light having a first maximum emission peak in a wavelength range of 460-490 nm during operation, and a second lighting element issuing light having a second maximum emission peak in a wavelength range of 430-460 nm during operation.

6. The lighting device as claimed in claim 3, characterized in that the first lighting element comprises a first LED and in that the second lighting element comprises a second LED.

7. The lighting device as claimed in claim 1, characterized in that the first emission peak is in a wavelength range of 465-475 nm, and the second emission peak is in a wavelength range of 445-455 nm.

8. The lighting device as claimed in claim 1, characterized in that for the mutually tuned first and second emission peak of the white emission spectrum the following requirement is essentially fulfilled:

$$I_1*R_1+I_2*R_2\approx constant,$$

wherein $I_1$ is the intensity of the emission spectrum at the first emission peak;

$R_1$ is the melatonin responsiveness at the first emission peak;

$I_2$ is the intensity of the emission spectrum at the second emission peak;

$R_2$ is the melatonin responsiveness at the second emission peak.

9. A lighting system as claimed in claim 1, wherein the control unit is configured to enable a user to switch from an energy efficient light setting to a healthier light setting by adjusting the ratio, wherein the healthier light setting reduces a risk of retinal damage in human eyes by lowering blue light in the generated source light.

10. A lighting system comprising:

a lighting device as claimed in claim 1 comprising a kit of parts, a user carried device, and a sensor and/or clock configured to measure or sense sensor data during operation, said sensor data comprising a location of the user carried device, (ambient)

spectral lighting conditions, and exposure time of the user carried device to the (ambient) spectral lighting conditions, the sensor is further configured to provide the control unit with a sensor signal based on the sensor data which sensor signal is processed by the control unit to tune both the ratio between the first and second emission peak and their absolute emission intensity during operation.

11. A lighting system as claimed in claim 10, characterized in that the control unit sets lighting conditions of the lighting system at or below a maximum illumination level of 2000 lux.

12. A lighting system as claimed in claim 10, characterized in that the user carried device is uploaded with personal user data, both said personal data and sensor data are processed by the control unit to adjust both the emission spectrum and intensity to the personal user during operation.

13. A lighting system as claimed in claim 10, characterized in that it further comprises a user interface for manual control of operation, wherein said user interface is selected from the group consisting of a smart phone, a remote control, a laptop, a tablet.

* * * * *